US006658671B1

(12) United States Patent
Von Holst et al.

(10) Patent No.: US 6,658,671 B1
(45) Date of Patent: Dec. 9, 2003

(54) PROTECTIVE HELMET

(75) Inventors: Hans Von Holst, Djursholm (SE); Peter Halldin, Enskede (SE)

(73) Assignee: Neuroprevention Scandinavia AB, Enskede (SE)

( * ) Notice: Subject to any disclaimer, the term of this patent is extended or adjusted under 35 U.S.C. 154(b) by 0 days.

(21) Appl. No.: 10/168,324

(22) PCT Filed: Dec. 21, 1999

(86) PCT No.: PCT/SE99/02451

§ 371 (c)(1),
(2), (4) Date: Jun. 20, 2002

(87) PCT Pub. No.: WO01/45526

PCT Pub. Date: Jun. 28, 2001

(51) Int. Cl.[7] ..... A42B 3/00
(52) U.S. Cl. ..... 2/412
(58) Field of Search ..... 2/411, 412, 413, 2/425

(56) References Cited

U.S. PATENT DOCUMENTS

| | | | | | |
|---|---|---|---|---|---|
| 3,039,108 | A | * | 6/1962 | Lohrenz | 2/412 |
| 4,012,794 | A | | 3/1977 | Nomiyama | |
| 4,064,565 | A | * | 12/1977 | Griffiths | 2/412 |
| 4,307,471 | A | | 12/1981 | Lovell | |
| 4,472,472 | A | * | 9/1984 | Schultz | 2/412 |
| 5,204,998 | A | * | 4/1993 | Liu | 2/411 |
| 5,815,846 | A | * | 10/1998 | Calonge | 2/413 |
| 2001/0032351 | A1 | * | 10/2001 | Nakayama et al. | 2/412 |
| 2002/0023291 | A1 | * | 2/2002 | Mendoza | 2/412 |

FOREIGN PATENT DOCUMENTS

| | | | | |
|---|---|---|---|---|
| DE | 3607583 A1 | * | 8/1987 | A42B/3/00 |
| GB | 2 136 676 | | 9/1984 | |
| SE | 9802228 | | 12/1999 | |
| SU | 1424788 A | * | 9/1988 | A42B/3/00 |
| WO | WO 96/14768 | | 5/1996 | |

* cited by examiner

*Primary Examiner*—Rodney M. Lindsey
(74) *Attorney, Agent, or Firm*—Young & Thompson

(57) ABSTRACT

A protective helmet (1) has an outer shell (2) and an inner shell (3), the outer shell being displaceable relative to the inner shell by means of at last one sliding layer (4) arranged between the the outer shell and the inner shell. In the edge region of the helmet, the outer shell and the inner shell are interconnected by means of members (5), for absorbing energy on displacement of the outer shell on the inner shell. In this way, impact energy from an oblique impact against the helmet can be absorbed during displacement between the outer shell and the inner shell.

12 Claims, 3 Drawing Sheets

PROTECTIVE HELMET

TECHNICAL FIELD

The invention relates to a protective helmet with an outer shell and an inner shell, according to the precharacterizing clause of Patent claim 1.

STATE OF THE ART

In order to prevent or reduce skull and brain injuries, it is customary to make use of protective helmets in various situations. Many different types of protective helmet, with different designs and characteristics, are available on the market. Generally speaking, such a helmet consists of a hard outer shell, often made of a composite material, and an energy-absorbing inner shell. Nowadays, a protective helmet has to be designed so as to satisfy certain legal requirements which relate to inter alia the maximum acceleration that may occur in the center of gravity of the brain at a specified load. Typically, tests are performed, in which what is known as a dummy skull equipped with a helmet is subjected to a radial blow from an impact surface. This has resulted in modern helmets having good energy-absorption capacity in the case of blows radially against the skull while the energy absorption for other load directions is not as optimal. The absence of legal requirements for how helmets are to reduce angular acceleration is due to inter alia the fact that injury criteria for rotational injuries are lacking.

In the case of linear acceleration (linear impact), it is typically fractures of the skull and/or pressure or abrasion injuries of the brain tissue which occur. Instances of pure angular acceleration (rotation about the center of rotation of the. skull) are rare. The commonest type of acceleration is rotational acceleration, that is to say combined linear and angular acceleration. Examples of rotational injuries are on the one hand subdural haematomas, SH, bleeding as a consequence of blood vessels rupturing, and on the other hand diffuse axonal injuries, DAI, which can be summarized as nerve fibres being severed as a consequence of varying inertia and density in the tissues of the brain. Depending on the characteristics of the rotational force, such as the duration, amplitude and rate of increase, either SH or DAI occur, or a combination of these is suffered. Generally speaking, SH occur in the case of short duration and great amplitude, while DAI occur in the case of longer and more widespread acceleration loads. It is important that these phenomena are taken into account so as to make it possible to provide good protection for the skull and brain.

OBJECT OF THE INVENTION

The aim of the invention is to produce a protective helmet which reduces the risk of injury for the wearer. Another aim is to produce a protective helmet which is simple, light and flexible for the wearer. A further aim is to produce an easily manufactured protective helmet.

DESCRIPTION OF THE INVENTION

An effective protective helmet is obtained with an embodiment which has features according to the characterizing clause of Patent claim 1.

By virtue of the fact that the outer shell of the helmet can be displaced relative to the inner shell during simultaneous absorption of rotational energy in the helmet, it is possible to reduce the injurious forces acting on the wearer, with a reduced risk of injury as a consequence.

The use of one or more relatively thin sliding layers means that the mass and construction height of the helmet can be kept down, which increases wearer comfort and further reduces the risk of injury.

By using an inner shell with the currently customary characteristics for protective helmets, a protective helmet is obtained, which is well suited to absorbing both radial impacts and oblique impacts and can thus protect the wearer well.

Further features and advantageous characteristics emerge from the description and patent claims below.

DESCRIPTION OF THE FIGURES

The invention is explained in greater detail below by means of exemplary embodiments shown in the drawings, in which.

DESCRIPTION OF PREFERRED EMBODIMENTS

Figure 1:
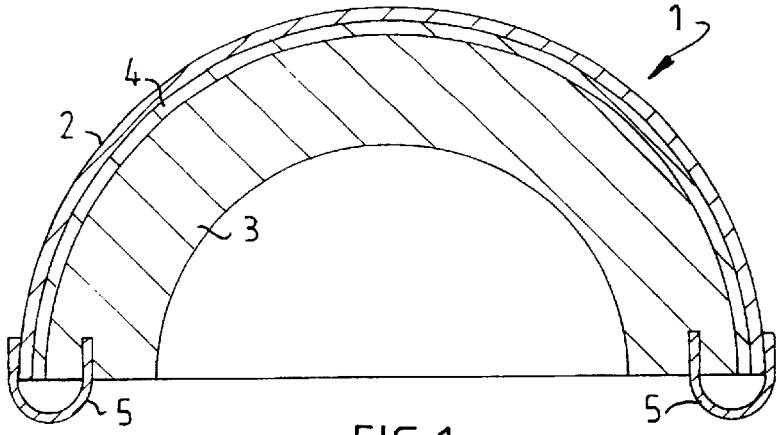
FIG. 1 shows diagrammatically a section through a protective helmet according to the invention.

A protective helmet 1 according to the invention shown diagrammatically in FIG. 1 is constructed from an outer shell 2 and, arranged inside the latter, an inner shell 3 which is intended for contact with the head of the wearer. Arranged between the outer shell 2 and the inner shell 3 is a sliding layer 4 which makes possible displacement between the outer shell 2 and the inner shell 3. Arranged in the edge portion of the helmet is or are one or more connecting members 5 which interconnect the outer shell 2 and the inner shell 3 and counteract mutual displacement between them by absorbing energy.

The outer shell 2 is relatively thin and strong so as to withstand impact of various types and can advantageously be made of, for example, fibre-reinforced plastic. The inner shell 3 is considerably thicker and is to be capable of damping or absorbing impacts against the head. It can advantageously be made of, for example, polyurethane foam or polystyrene. The construction can be varied in different ways, which emerge below, with, for example, a number of layers of different materials. A number of different materials and embodiments can be used as the sliding layer 4, for example oil, Teflon, microspheres, air, rubber etc. This layer advantageously has a thickness of roughly 0.1–5 mm, but other thicknesses can also be used, depending on the material selected and the performance desired. As connecting members 5, use can be made of, for example, deforinable strips of plastic or metal which are anchored ill the outer shell and the inner shell in a suitable manner.

Figure 2:
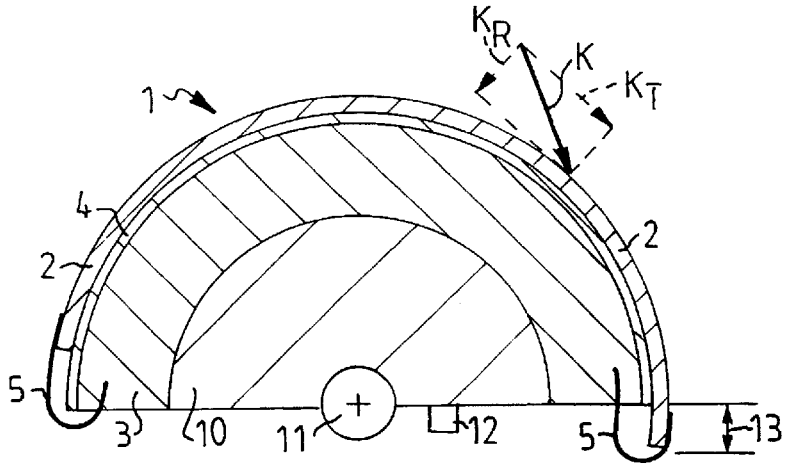
FIG. 2 shows the protective helmet in FIG. 1 when it is subjected to an oblique impact.

FIG. 2 shows the functioning principle of a protective helmet 1 according to the invention, with a simplified model in a two-dimensional embodiment, where the helmet 1 and a skull 10 are semi-cylindrical, with the skull 10 being mounted on a longitudinal axis 11. A little way from the axis 11 is a sensor 12 for measuring the torsional force and the torque transmitted to the skull 10 when the helmet 1 is subjected to an oblique impact K which gives rise to both a tangential force $K_T$ and a radial force $K_R$ against the protective helmet 1. In this particular context, only the helmet-rotating tangential force $K_T$ and its effect are of interest.

As can be seen, the force K gives rise to a displacement 13 of the outer shell 2 relative to the inner shell 3, the connecting members 5 being deformed.

Figure 4:
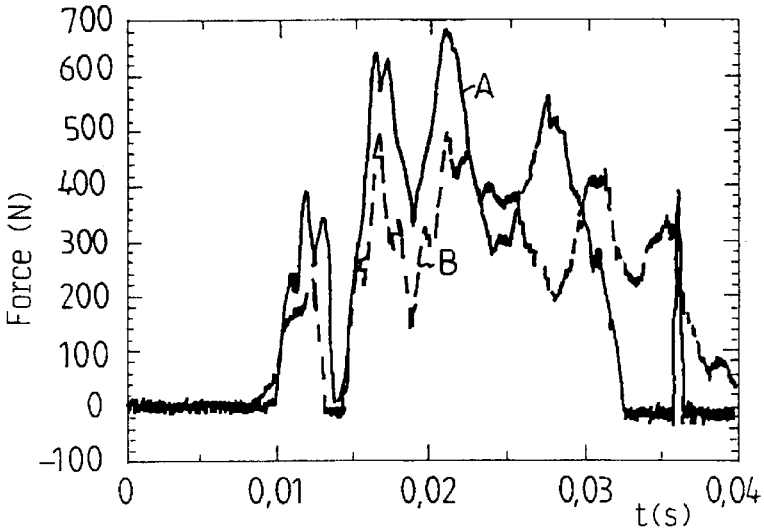
FIG. 4 shows the relationship between time and force in the case of an oblique impact against two different types of helmet, according to FIG. 2, FIGS. 5 and 6 show the results from a numerical study in the case of oblique impacts against a skull provided with a helmet.

A number of tests were carried out, on the one hand on a helmet according to the invention with an oil film as the sliding layer, and on the other hand on a conventional helmet with the outer shell glued rigidly to the inner shell. The mean value of a number of tests was calculated and is shown in FIG. 4 where the force measured in the sensor 12 is shown as a function of time. The conventional helmet is represented by the continuous curve A, and the helmet according to the invention is represented by the dashed curve B.

As can be seen, a significant improvement (lower force) of roughly 25% is obtained with an embodiment according to the invention.

Figure 3A:
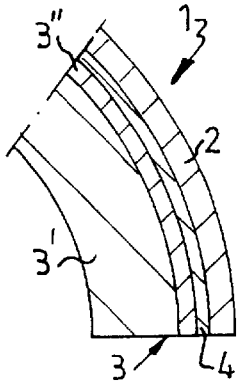
FIGS. 3*a*, 3*b* and 3*c* shows alternative embodiments of the protective helmet according to the invention.
Figure 3B:
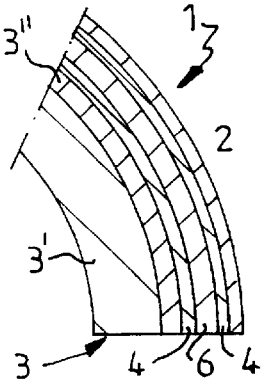
Figure 3C:
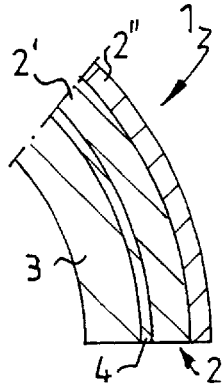

In addition to the embodiment shown in FIG. 1, a number of other embodiments of the protective helmet 1 are also possible. A few possible variants are shown in FIG. 3. In FIG. 3*a*, the inner shell 3 is constructed from a harder, relatively thin outer layer 3" and a softer, relatively thick inner layer 3'. In FIG. 3*b*, the inner shell 3 is constructed in the same manner as in FIG. 3*a*. In this case, however, there are two sliding layers 4, between which there is an intermediate shell 6. The two sliding layers 4 can, if so desired, be embodied differently and made of different materials. One possibility, for example, is to have lower friction in the outer sliding layer than in the inner. In FIG. 3*c*, finally, the outer shell 2 is embodied differently to previously. In this case, a harder outer layer 2" covers a softer inner layer 2'. The proportions of the thicknesses of the various layers have been exaggerated in the drawing for the sake of clarity and can of course be adapted according to need and requirements.

Figure 5:
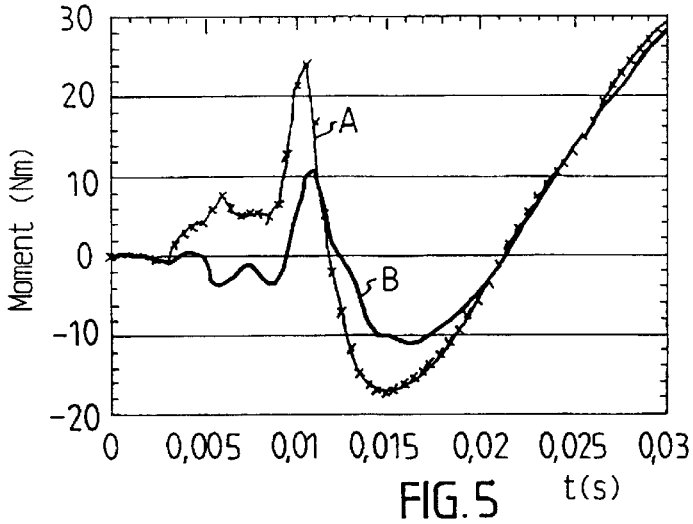
Figure 6:
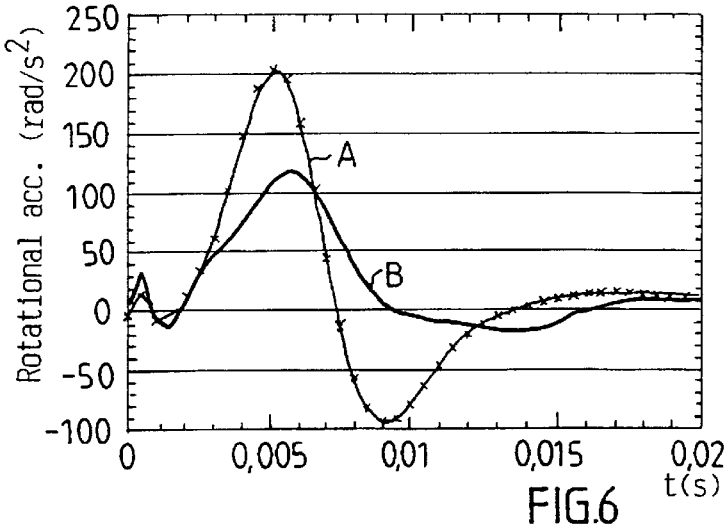

FIGS. 5 and 6 show the result from a numerical study performed by means of a dynamic Finite Element (FE) program. First, a 2D geometric model was produced and was validated by good consistency with experiments. Then a 3D model was made with nape and head from what is known as a Hybrid III dummy which is used in collision simulation in the automotive industry. On the one hand a conventional helmet and on the other hand a helmet with an outer shell, a sliding layer, an inner shell and connecting members, according to the invention, were used on the head. The connecting members were modelled using plastic spring elements. The torque was calculated at a fixing point between the skull and the nape (see FIG. 5), and the rotational acceleration was calculated at the center of gravity of the skull (see FIG. 6).

As can be seen from FIG. 5, for a helmet according to the invention, the thick continuous curve B, a reduction in the torque about the fixing point between the skull and the nape by roughly 50% is obtained in comparison with a conventional helmet, the thin curve A. Correspondingly, it can be seen from FIG. 6 that for a helmet according to the invention, the thick continuous curve B, a reduction in the rotational acceleration at the center of gravity of the skull by roughly 45% is obtained in comparison with a conventional helmet, the thin curve A.

This study shows that a protective helmet according to the invention has great possibilities for reducing the level of injury of a helmet wearer.

Figure 7:
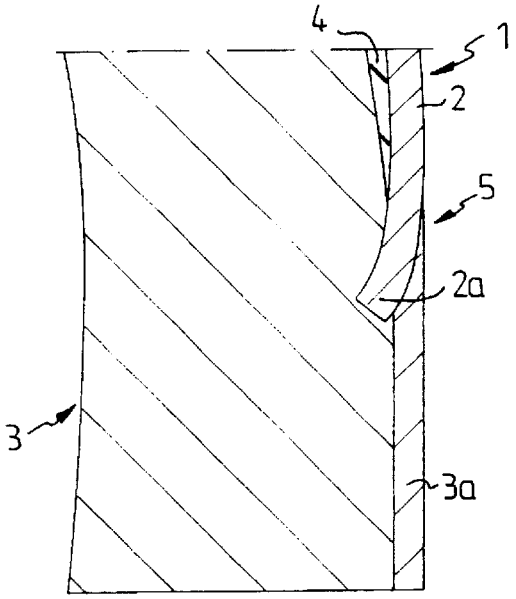
FIGS. 7–9 shows various embodiments of the connection between the outer shell and the inner shell in a protective helmet according to the invention.
Figure 8:
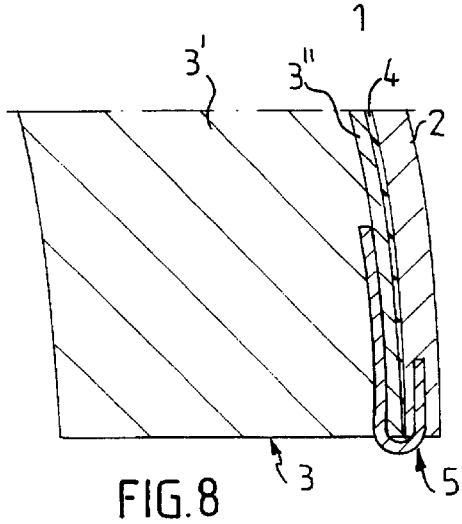
Figure 9:
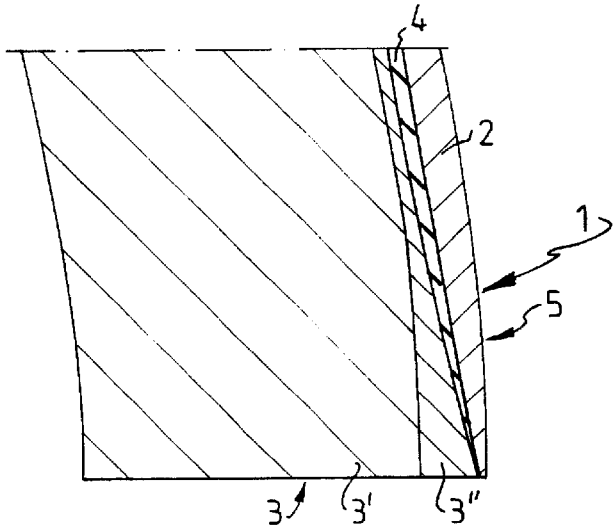
Figure 10:
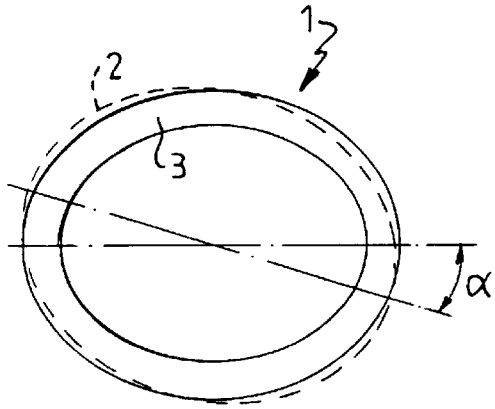
FIG. 10 shows diagrammatically from above the relative movement between the outer shell and the inner shell in an embodiment according to FIG. 9.

A number of possible embodiments and the positioning of energy-absorbing connecting members 5 are shown in FIGS. 7–9.

According to FIG. 7, the inner shell 3 is made of relatively soft material and can allow penetration of a lower, inwardly bent edge 2*a* on the outer shell 2 when the latter is displaced relative to the inner shell 3. On the outside of the inner shell 3, there is a covering layer 3*a* which rigidities the inner shell 3 and at the same time contributes to the design of the protective helmet. This embodiment can be modified in various ways, as required.

The embodiment shown in FIG. 8 corresponds essentially to the embodiment according to FIG. 1. However, the difference is that the helmet itself is constructed according to FIG. 3, with a harder outer layer 3" and a softer inner layer 3' in the inner shell 3. The connecting member 5 is in this case fastened in the harder, stronger outer layer 3".

FIG. 9 shows an embodiment in which the connecting member 5 consists of a progressive clamp joint, the lower part of the outer shell 2 and the lower part of the harder outer layer 3" of the inner shell 3 being bevelled so that, on displacement of the outer shell, clamping is brought about, with increased friction as a consequence.

The term sliding layer used above means a layer which is located between two parts and facilitates mutual displacement of these, by sliding or in another manner. The construction of the sliding layer can vary within wide limits, in terms of both material and design. The number of sliding layers and their positioning can also be varied.

What is claimed is:

1. Protective helmet in which, between an outer shell (2) and an inner shell (3) arranged inside the latter, there is a sliding layer (4) for making possible displacement of the outer shell relative to the inner shell in the event of an oblique impact against the protective helmet, the protective helmet having connecting members (5), which interconnect the outer shell and the inner shell, characterized in that the outer shell (2) is of the hard type and is harder in the radial direction of the helmet than the inner shell (3), in that the connecting member (5) comprise of an energy absorbing connecting member (5) which is deformable, whereby impact energy is absorbed during displacement between the outer shell and the inner shell.

2. Protective helmet according to claim 1, characterized in that the outer shell (2) and the inner shell (3) are connected to each other with at least one connecting member (5) at the edge portion of the helmet.

3. Protective helmet according to claim 1, characterized in that the connecting member/members (5) comprise of deformable strips of plastic.

4. Protective helmet according to claim 1, characterized in that the connecting member/members (5) is/are arranged against the outside of the outer shell (2).

5. Protective helmet according to claim 1, characterized in that the outside (3") of the inner shell (3) is made of a harder material than the rest of the inner shell (3').

6. Protective helmet according to claim 1, characterized in that the material in the sliding layer (4) is oil.

7. Protective helmet according to claim 1, characterized in that the material in the sliding layer (4) is microspheres.

8. Protective helmet according to claim 1, characterized in that the material in the sliding layer (4) is Teflon.

9. Protective helmet according to claim 1, characterized in that the connecting member/members (5) is/are arranged in the outer shell (2).

10. Protective helmet according to claim 1, characterized in that the connecting member/members (5) is/are arranged in the inner shell (3).

11. Protective helmet according to claim 1, characterized in that the inner shell (3) is constructed from a harder outer layer (3") and a softer inner layer (3'), where the connecting member/members (5) is/are attached in the harder outer layer (3").

12. Protective helmet according to claim 1, characterized in that the thickness of the sliding layer (4) is within the range 0.1–5 mm.

* * * * *